US011353018B2

(12) United States Patent
Aono et al.

(10) Patent No.: US 11,353,018 B2
(45) Date of Patent: Jun. 7, 2022

(54) PISTON PUMP

(71) Applicant: ADVICS CO., LTD., Kariya (JP)

(72) Inventors: Tomokazu Aono, Chiryu (JP); Tomoo Harada, Anjo (JP)

(73) Assignee: ADVICS CO., LTD., Kariya (JP)

( * ) Notice: Subject to any disclaimer, the term of this patent is extended or adjusted under 35 U.S.C. 154(b) by 0 days.

(21) Appl. No.: 17/054,583

(22) PCT Filed: May 24, 2019

(86) PCT No.: PCT/JP2019/020650
§ 371 (c)(1),
(2) Date: Nov. 11, 2020

(87) PCT Pub. No.: WO2019/225739
PCT Pub. Date: Nov. 28, 2019

(65) Prior Publication Data

US 2021/0180589 A1 Jun. 17, 2021

(30) Foreign Application Priority Data

May 25, 2018 (JP) ..... JP2018-100542

(51) Int. Cl.
*F04B 53/14* (2006.01)
*F04B 53/10* (2006.01)
*F04B 53/12* (2006.01)

(52) U.S. Cl.
CPC ..... *F04B 53/14* (2013.01); *F04B 53/1002* (2013.01); *F04B 53/108* (2013.01);
(Continued)

(58) Field of Classification Search
CPC ..... F04B 53/125; F04B 53/14; F04B 53/126; F04B 53/1002; F04B 53/1075; F04B 53/1087; F04B 53/108; F04B 53/121
See application file for complete search history.

(56) References Cited

U.S. PATENT DOCUMENTS 7,806,671 B2 * 10/2010 Maeda ..... B60T 8/4031 417/471
2008/0206081 A1 * 8/2008 Harada ..... F04B 1/0408 417/498

(Continued)

FOREIGN PATENT DOCUMENTS

JP 2008309130 A 12/2008
JP 2011503414 A 1/2011

(Continued)

OTHER PUBLICATIONS

International Search Report (with English Translation) and Written Opinion issued in corresponding International Patent Application No. PCT/JP2019/020650, 9 pages (dated Aug. 27, 2019).

*Primary Examiner* — Kenneth J Hansen
*Assistant Examiner* — David N Brandt
(74) *Attorney, Agent, or Firm* — Buchanan Ingersoll & Rooney PC

(57) ABSTRACT

In a piston pump, for example, a piston sub assembly includes a columnar plunger that lies along an axial direction, a cap that is fixed with the plunger to cover an adjacent region between a first end surface at one end in the axial direction of the plunger and the first end surface at a first outer circumferential surface of the plunger, and provided with an intake passage extending from an inlet on an outer side of the first outer circumferential surface to an outlet on an outer side of the first end surface outside the plunger, and a first valve seat of a first intake check valve located at the outlet, and a seal member that is a member different from the cap and that prevents leakage of hydraulic fluid from the first chamber through a gap between the first cylinder and the piston sub assembly.

9 Claims, 9 Drawing Sheets

(52) U.S. Cl.
CPC ..... *F04B 53/1075* (2013.01); *F04B 53/1087* (2013.01); *F04B 53/121* (2013.01); *F04B 53/126* (2013.01)

(56) References Cited

U.S. PATENT DOCUMENTS

| | | | | |
|---|---|---|---|---|
| 2008/0310971 | A1 | 12/2008 | Harada | |
| 2010/0247358 | A1 | 9/2010 | Hermann | |
| 2011/0239857 | A1* | 10/2011 | Iyatani | F04B 53/125 92/163 |
| 2011/0277626 | A1* | 11/2011 | Asai | F01B 9/026 92/249 |

FOREIGN PATENT DOCUMENTS

| | | | |
|---|---|---|---|
| JP | 2011038423 | A | 2/2011 |
| JP | 2011214520 | A | 10/2011 |

* cited by examiner

PISTON PUMP

TECHNICAL FIELD

The present disclosure relates to a piston pump.

BACKGROUND ART

A piston pump in the art including a piston sub assembly in which one end of a columnar piston is covered with a large-diameter piston of another member (e.g., Japanese Unexamined Patent Application Publication No. 2011-214520). In the piston pump of the document, the large-diameter piston is provided with a passage for the hydraulic fluid, and a seal portion that seals the clearance between a valve seat of an intake check valve and a cylinder.

SUMMARY OF INVENTION

Technical Problems

The piston pump has sometimes been difficult to obtain a material capable of ensuring both the sealing performance of the seal portion and the rigidity and strength against the pressurization by the hydraulic fluid, if the piston pump has the large-diameter piston.

One of the problems of the present disclosure is to obtain a piston pump having a novel configuration with less drawbacks, for example, by including a piston sub assembly that can be configured by a more suitable material.

Solutions to Problems

A piston pump of the present disclosure relates to, for example, a piston pump including a first cylinder, and a piston sub assembly that reciprocates in an axial direction of the first cylinder in the first cylinder to expand and contract a first chamber provided between the first cylinder and the piston sub assembly; where the piston sub assembly includes a columnar plunger that lies along the axial direction, a cap that is fixed with the plunger to cover an adjacent region between a first end surface at one end in the axial direction of the plunger and the first end surface at a first outer circumferential surface of the plunger, and provided with an intake passage extending from an inlet on an outer side of the first outer circumferential surface to an outlet on an outer side of the first end surface outside the plunger, and a first valve seat of a first intake check valve located at the outlet, and a seal member that is a member different from the cap and that prevents leakage of hydraulic fluid from the first chamber through a gap between the first cylinder and the piston sub assembly.

According to such a configuration, for example, since the cap and the seal member are separate members, the piston sub assembly can be made of a more suitable material as compared with when the cap and the seal member are integrally formed.

DESCRIPTION OF EMBODIMENT

Figure 1:
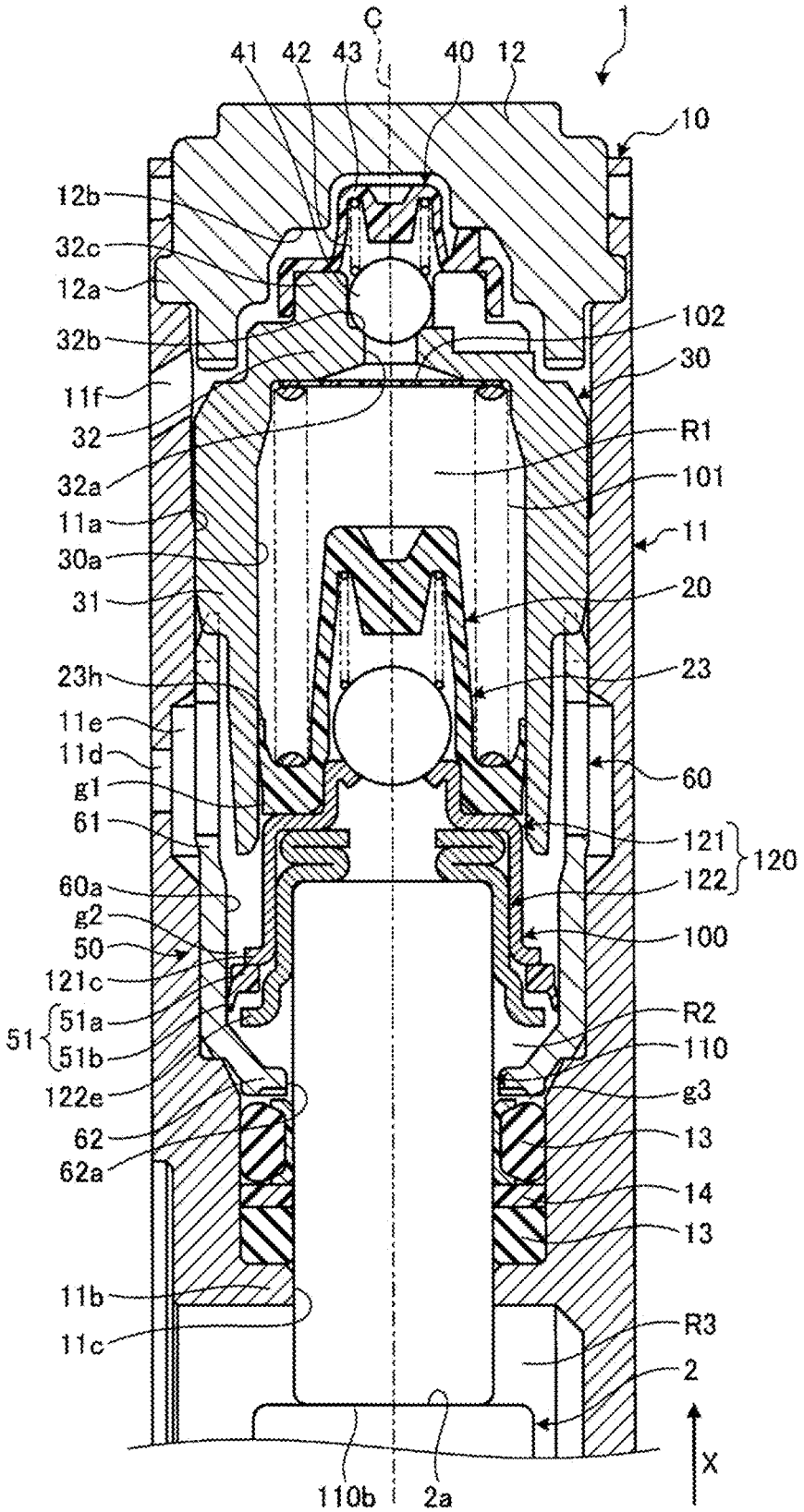
FIG. 1 is an exemplary and schematic cross-sectional view of a piston pump of an embodiment.

An exemplary embodiment of the present disclosure will be disclosed below. The configurations of the embodiment illustrated below, and the operations and results (effects) provided by the configurations are merely examples. The present disclosure can also be realized with configurations other than the configurations disclosed in the following embodiment.

The ordinal numbers are given for convenience of distinguishing components, parts, and the like, and do not indicate the priority or the order in the present specification. Additionally, for the sake of convenience of explanation, the axial direction along the center line C of each part such as a first cylinder 30, a plunger 110, and the like of a piston pump 1 is simply referred to as the axial direction hereinafter. The direction in which the plunger 110 is pressed by a cam 2 moves is referred to as axially forward, which is arrow X in each drawing. Axially rearward is the direction in which the plunger 110 pressed by a return spring 101 returns so as to approach the cam 2, or the direction opposite to the pressing direction of the plunger 110 by the cam 2. In addition, the radial direction of the center line C may be simply referred to as the radial direction, and the circumferential direction of the center line C may be simply referred to as the circumferential direction.

FIG. 1 is a cross-sectional view of the piston pump 1. As illustrated in FIG. 1, the piston pump 1 includes a housing 10, a first intake check valve 20, a first cylinder 30, a discharge check valve 40, and a piston sub assembly 100.

The piston sub assembly 100 is pressed forward (upward in FIG. 1) in the axial direction (direction X) by the cam 2 and is urged rearward (downward in FIG. 1) in the axial direction by the return spring 101. The position of an outer circumference 2*a* of the cam 2 iteratively changes in the axial direction (vertical direction in FIG. 1) as the cam 2 rotates. With such a configuration, the piston sub assembly 100 repeatedly reciprocates in the axial direction (direction X) of the first cylinder 30 as the cam 2 rotates.

As the piston sub assembly 100 iteratively reciprocates in the axial direction, a first chamber R1 provided between the piston sub assembly 100 and the first cylinder 30 alternately repeats expansion and contraction. As the piston sub assembly 100 is moved axially rearward and the first chamber R1 is expanded, the hydraulic fluid is taken into the first chamber R1 through the passage provided in the piston pump 1 from an intake port 11*d* (intake step). In the intake step, the first intake check valve 20 is opened and the discharge check valve 40 is closed. On the other hand, as the piston sub assembly 100 is moved axially forward and the first chamber R1 is contracted, the hydraulic fluid is discharged to a discharge port 11*f* through the passage provided in the piston pump 1 from the first chamber R1 (discharge step). In the discharge step, the first intake check valve 20 is closed and the discharge check valve 40 is opened.

The housing 10 has a body 11 and a plug 12. The body 11 is provided with an accommodation hole 11*a* for accommodating the components of the piston pump 1. The accommodation hole 11*a* has a bottomed cylindrical shape centered on the center line C. A bottom wall 11*b* of the accommodation hole 11*a* is provided with a through hole 11*c* penetrating in the axial direction, and the plunger 110 of the piston sub assembly 100 is passed through the through hole 11*c*. Furthermore, an annular groove 11*e*, to which the intake port 11*d* is opened, is provided on an inner circumferential surface of the accommodation hole 11*a*, and the discharge port 11*f* is opened axially forward of the annular groove 11*e*.

The plug 12 closes the open end on the axially front side of the accommodation hole 11*a*. The plug 12 has a flange 12*a*, and the plug 12 is fixed to the body 11 by caulking a portion of the body 11 adjacent to the flange 12*a*. The method of fixing the plug 12 is not limited to caulking. Furthermore, the plug 12 is provided with a recess 12*b* that is opened axially rearward, and a part of the first cylinder 30 and the discharge check valve 40 is accommodated in the recess 12*b*.

Figure 2:
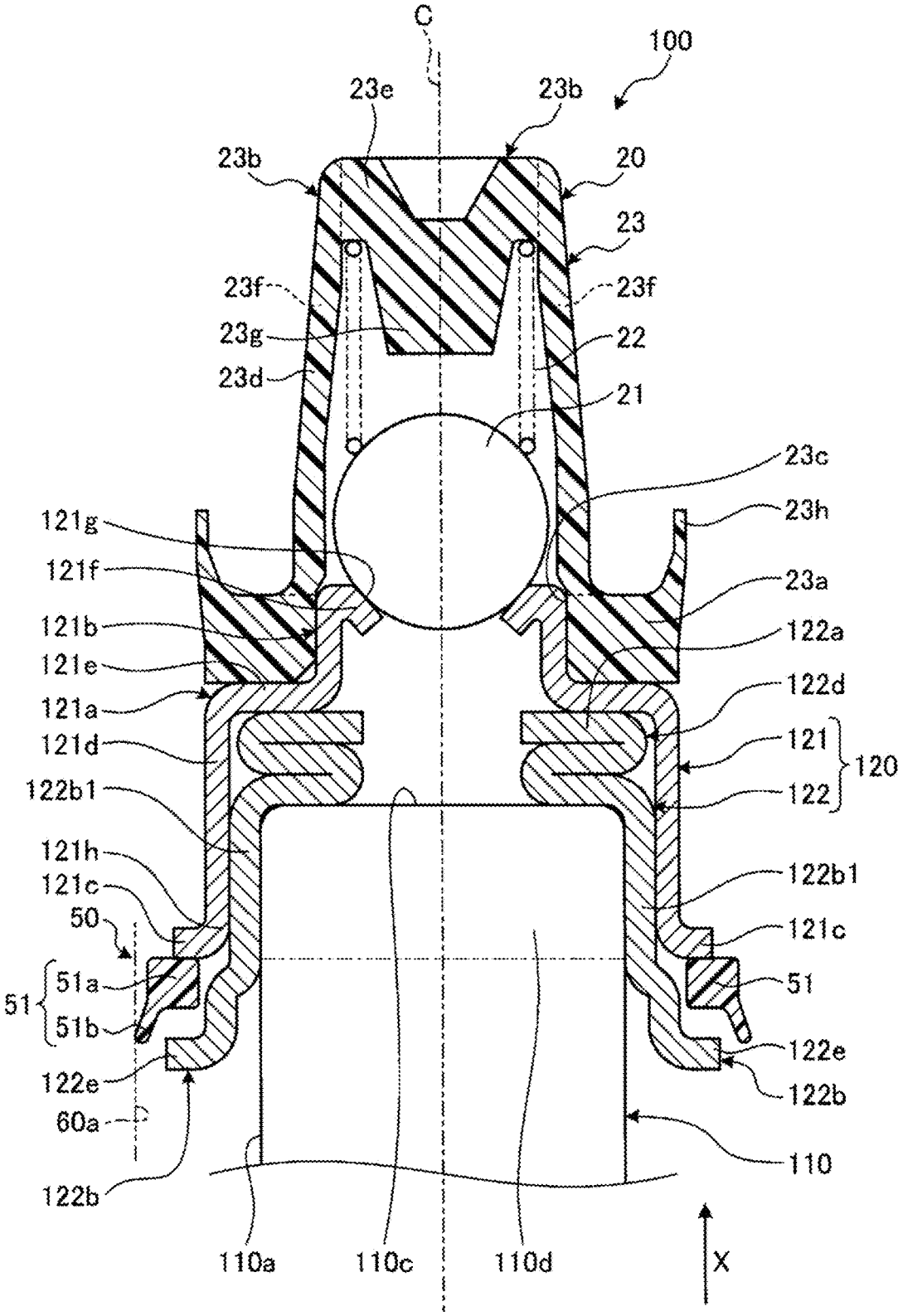
FIG. 2 is an exemplary and schematic cross-sectional view of a piston sub assembly included in the piston pump of the embodiment.

FIG. 2 is a cross-sectional view of the piston sub assembly 100. As illustrated in FIG. 2, the piston sub assembly 100 includes a plunger 110, a cap 120, and a first intake check valve 20.

The plunger 110 has a substantially columnar shape, and has an outer circumferential surface 110*a* serving as a cylindrical surface, an end surface 110*b* (FIG. 1) serving as a circular flat surface on the axially rear side, and an end surface 110*c* serving as a circular flat surface on the axially front side. The outer circumferential surface 110*a* and the end surfaces 110*b* and 110*c* are examples of outer surfaces. The plunger 110 is made of, for example, a metal material such as an iron-based material. The plunger 110 may be, for example, a needle for a needle bearing.

The cap 120 is fixed to an end, or one end, on the axially front side of the plunger 110, and covers the end surface 110*c* and an end outer circumference 110*d* having a substantially cylindrical surface shape adjacent to the end surface 110*c* of the outer circumferential surface 110*a*. The end surface 110*c* is an example of a first end surface, and the end outer circumference 110*d* is an example of an adjacent region. The cap 120 has a cover 121 and a spacer 122. The cap 120 is made of, for example, a metal material such as an iron-based material.

Figure 3:
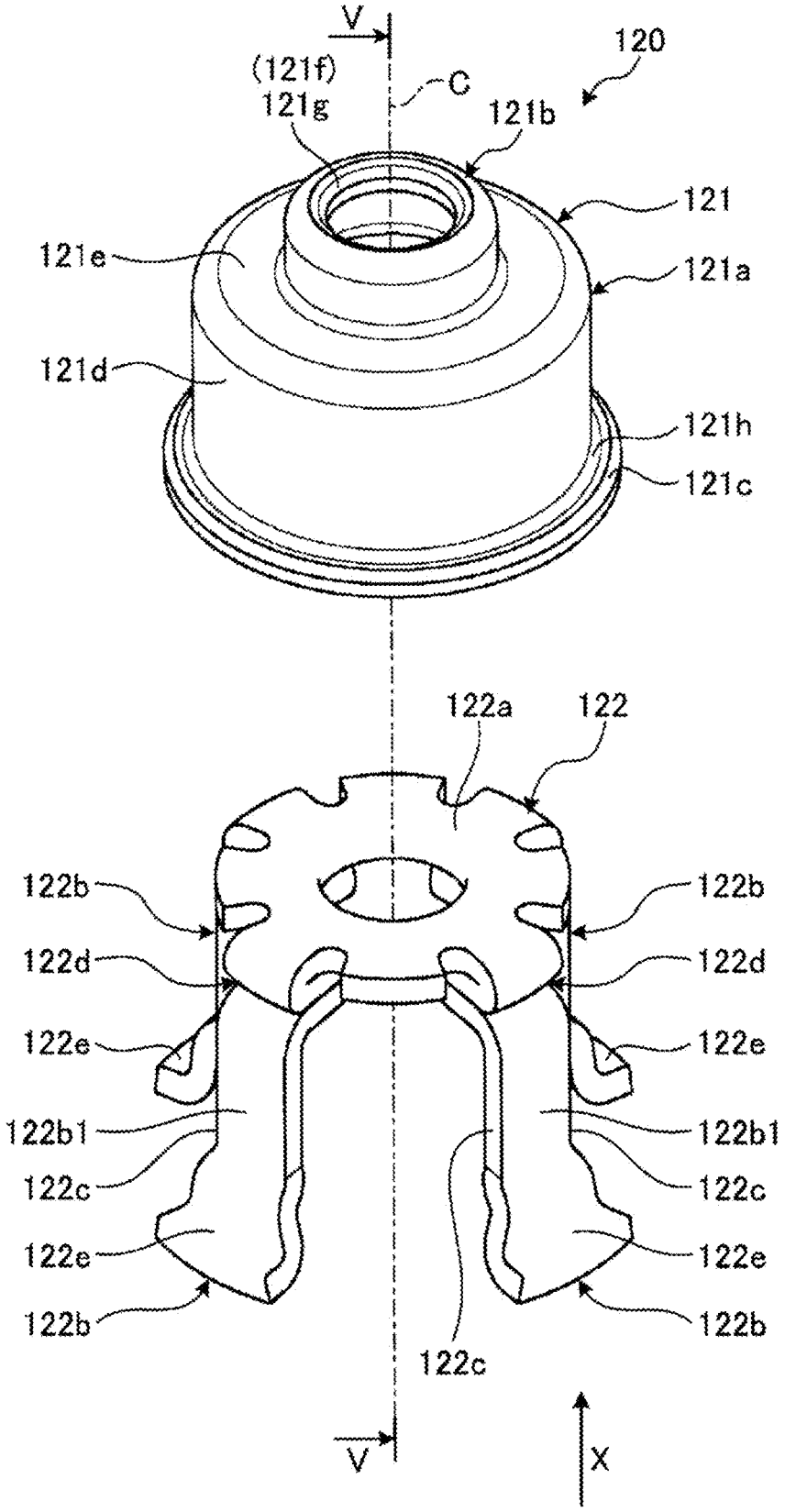
FIG. 3 is an exemplary and schematic exploded perspective view of a cap included in the piston pump of the embodiment.
Figure 4:
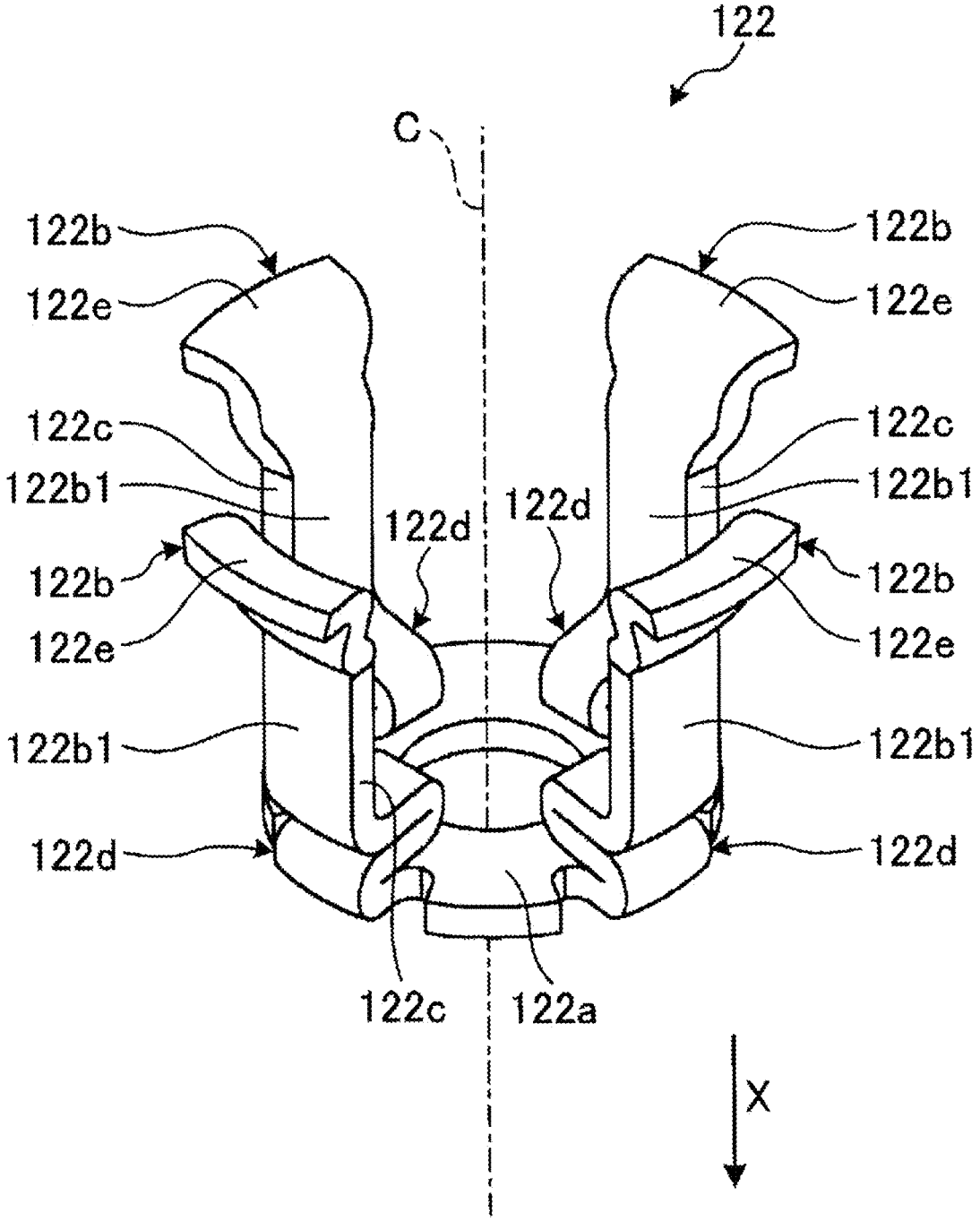
FIG. 4 is an exemplary and schematic perspective view of a spacer included in the piston pump of the embodiment as viewed from a direction different from FIG. 3.

FIG. 3 is an exploded perspective view of the cap 120, and FIG. 4 is a perspective view of the spacer 122 forming the cap 120 as viewed from the side opposite to FIG. 3. As illustrated in FIGS. 2 and 3, the cover 121 has a body 121*a*, a protrusion 121*b*, and a flange 121*c*. The body 121*a* has a bottomed cylindrical shape, and has a substantially cylindrical peripheral wall 121*d* and a substantially disc-shape annular top wall 121*e*.

As illustrated in FIG. 2, the substantially cylindrical protrusion 121*b* projects from the inner edge of the top wall 121*e* so as to be separated from the peripheral wall 121*d*. Furthermore, from the tip of the protrusion 121*b* on the side opposite to the top wall 121*e*, there is projected an annular inward flange 121*f* extending so as to approach the top wall 121*e* in an oblique direction between the radially inner side and the axially rear side. An outer surface 121*g* axially forward of the inward flange 121*f* is a substantially conical inner surface and functions as a valve seat of the first valve body 21 of the first intake check valve 20. The outer surface 121*g* is an example of a first valve seat.

The flange 121*c* projects radially outward from an end edge 121*h* of the peripheral wall 121*d* on the side opposite to the top wall 121*e*.

The cover 121 has a substantially constant thickness as a whole. The cover 121 is made of, for example, a metal material such as an iron-based material. Furthermore, for example, the cover 121 can be molded by press working such as drawing or bending of a metal plate.

Moreover, as illustrated in FIG. 2, the spacer 122 is sandwiched between the cover 121 and the plunger 110.

As illustrated in FIGS. 3 and 4, the spacer 122 has a base 122*a* and a plurality of legs 122*b*. The base 122*a* has a substantially disc-shape and annular shape. The legs 122*b* project out from four locations on the outer edge of the base 122*a*. The four legs 122*b* are arranged at approximately 90° intervals in the circumferential direction. The leg 122*b* extends along the axial direction with a substantially constant width. The leg 122*b* has a substantially band shape and a plate shape. The leg 122*b* may also be referred to as a peripheral wall. Furthermore, a notch 122*c* is provided between the two legs 122*b* adjacent to each other. In other words, the peripheral wall of the spacer 122 is provided with a plurality of (four) notches 122*c* extending in the axial direction from the side opposite to the base 122*a* so as to approach the base 122*a*. The notch 122*c* may also be referred to as an opening. The number of legs 122*b* and notches 122*c* may be less than four or more than four.

As illustrated in FIGS. 2 to 4, a bent portion 122*d* is provided between the base 122*a* and the leg 122*b*. The bent portion 122*d* is configured by partially folding the root of the leg 122*b* into a zigzag shape so as to be folded. Specifically, each of the legs 122*b* is bent radially inward at approximately 180° at the outer edge of the base 122*a* at the boundary portion with the base 122*a*, and furthermore, is bent radially outward at approximately 180° at a position substantially overlapping with the inner edge of the base 122*a* in the axial direction, and is further bent approximately 90° so as to separate from the base 122*a* in the axial direction at a position substantially overlapping the outer edge of the base 122*a* in the axial direction, thus molding the bent portion 122*d* and a part 122*b*1 of the leg 122*b* extending in the axial direction. The four bent portions 122*d* are arranged at approximately 90° intervals in the circumferential direction. The number of bent portions 122*d* may be less than four or more than four.

Furthermore, a claw 122*e* projecting radially outward is provided at the tip of the leg 122*b* on the side opposite to the base 122*a*. The claw 122*e* can also be called a protrusion or an outward protrusion.

The spacer 122 has a substantially constant thickness as a whole. The spacer 122 is made of, for example, a metal material such as an iron-based material. Furthermore, for example, the spacer 122 can be molded by press working such as bending of a metal plate.

As illustrated in FIGS. 2 and 3, the spacer 122 is placed over to cover the end surface 110*c* and the end outer circumference 110*d* of the plunger 110, and the cover 121 is placed over the spacer 122 to cover the end surface 110*c* and the end outer circumference 110*d* of the plunger 110 through the spacer 122. The plunger 110, the spacer 122, and the cover 121 are integrated by press fitting. As illustrated in FIG. 2, in the piston sub assembly 100 in which the plunger 110, the spacer 122, and the cover 121 are integrated, the base 122*a* is sandwiched between the end surface 110*c* of the plunger 110 and the top wall 121*e* of the cover 121, and the leg 122*b* (part 122*b*1) is sandwiched between the end outer circumference 110*d* of the plunger 110 and the peripheral wall 121*d* of the cover 121.

As illustrated in FIG. 2, an annular seal member 51 that surrounds the spacer 122 is located between the flange 121*c* of the cover 121 and the claw 122*e* of the spacer 122. The seal member 51 has a base ring 51*a* and a seal lip 51*b*. The seal lip 51*b* has an annular shape, and extends axially rearward from the outer edge of the base ring 51*a* also and slightly extends radially outward. As illustrated in FIG. 1, the outer circumference of the seal lip 51*b* is in contact with the inner circumferential surface 60*a* of the second cylinder 60. The seal member 51 can be made of, for example, a synthetic resin material.

The seal member 51 is provided to be movable in the axial direction between a position in contact with the flange 121*c* and a position in contact with the claw 122*e*, with the seal lip 51*b* in contact with the inner circumferential surface 60*a* of the second cylinder 60. The seal member 51 closes the annular gap g2 (clearance) between the second cylinder 60 and the piston sub assembly 100 while being in contact with the flange 121*c*, and prevents the backflow of the hydraulic fluid from the second chamber R2 to the intake port 11*d* through the gap g2. On the other hand, in a state where the seal member 51 is in contact with the claw 122*e*, the notch 122*c* (FIG. 3) of the spacer 122 is opened between the flange 121*c* and the claw 122*e*, so that the second chamber R2 and the intake port 11*d* are connected through the notch 122*c*.

Figure 5:
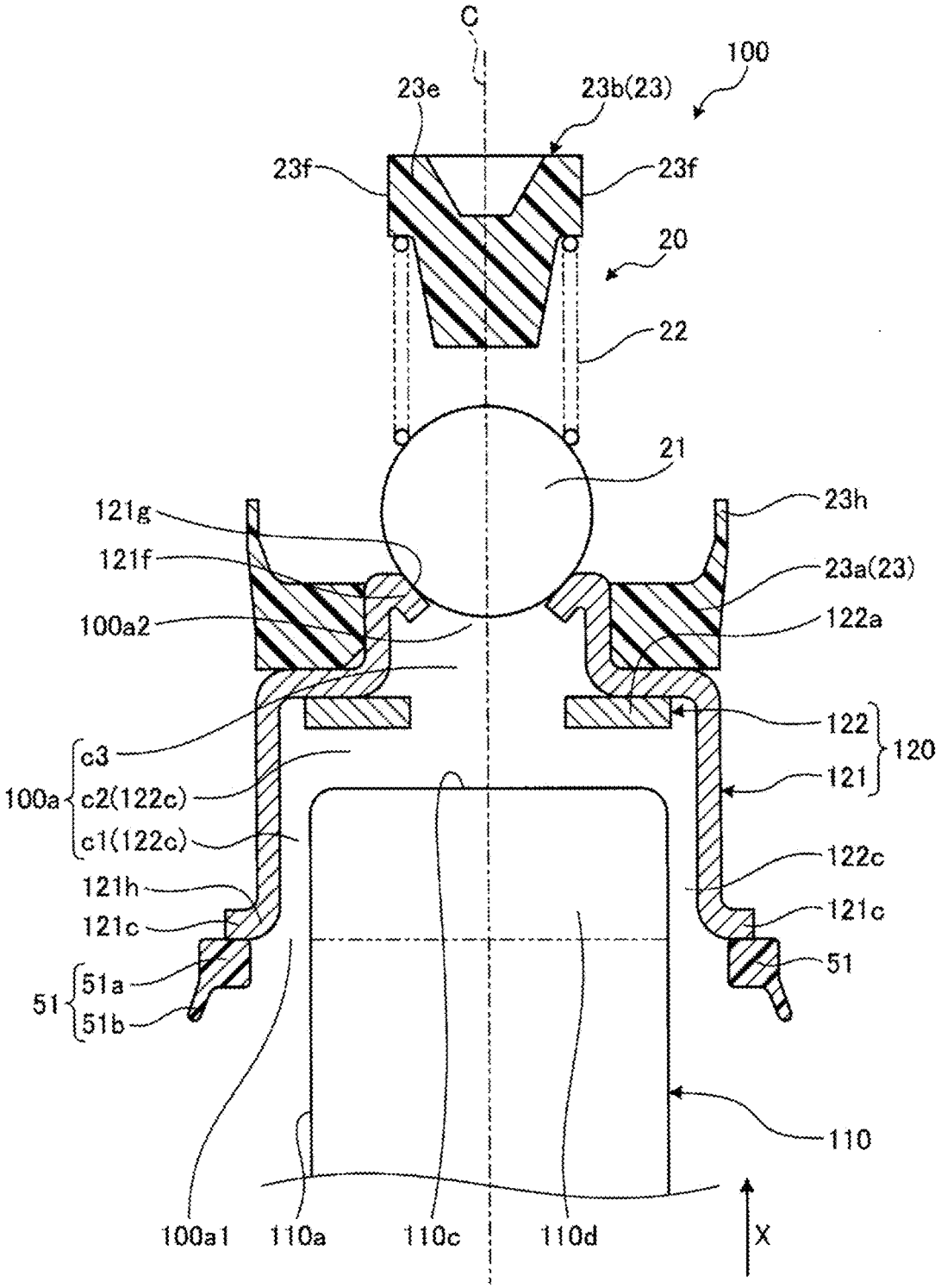
FIG. 5 is an exemplary and schematic cross-sectional view of the piston sub assembly included in the piston pump of the embodiment at a cross-sectional position at the position taken along line V-V in FIG. 3.

FIG. 5 is a cross-sectional view of a part of the piston sub assembly 100 at a position taken along V-V in FIG. 3. As illustrated in FIG. 5, a gap c1 is provided between the end outer circumference 110*d* and the cover 121, and between the two legs 122*b* (see FIG. 3) adjacent to each other in the circumferential direction. Furthermore, a gap c2 is provided between the end surface 110*c* and the base 122*a* and between the two bent portions 122*d* (see FIG. 3) adjacent to each other in the circumferential direction. The gap c1 and the gap c2 are connected to each other and also to a gap c3 between the end surface 110*c* and the cover 121 (protrusion 121*b*). Between the plunger 110 and the cover 121, in other words, inside the piston sub assembly 100, the gaps c1, c2, c3 formed by partially interposing the spacer 122 between the plunger 110 and the cover 121 form a passage 100*a* extending along the outer circumferential surface 110*a* and the end surface 110*c* (outer surface) of the plunger 110. The passage 100*a* extends between an inlet 100*a*1 on the outer side of the outer circumferential surface 110*a* and an outlet 100*a*2 on the outer side of the end surface 110*c*. The inlet 100*a*1 is between the end edge 121*h* of the cover 121 and the outer circumferential surface 110*a* of the plunger 110, and the outlet 100*a*2 is adjacent to the seal region between the outer surface 121*g* serving as the first valve seat of the first intake check valve 20 and the first valve body 21. The passage 100*a* is an example of an intake passage to the first chamber R1 (FIG. 1). The notch 122*c* (FIGS. 3 and 4) of the spacer 122 that forms the gaps c1 and c2 (passage 100*a*) is an example of a first opening. Furthermore, as will be apparent with reference to FIGS. 2 and 5, since the bent portion 122*d* is provided, the axial thickness of the spacer 122 between the end surface 110*c* of the plunger 110 and the top wall 121*e* of the cover 121 increases, and it can be understood that as compared with the configuration in which the bent portion 122*d* is not provided, the height of the gap c2 in the axial direction, that is, the cross-sectional area of the passage 100*a* may increase. The gap c2 increases as the number of bends of the bent portion 122*d* increases.

Figure 6:
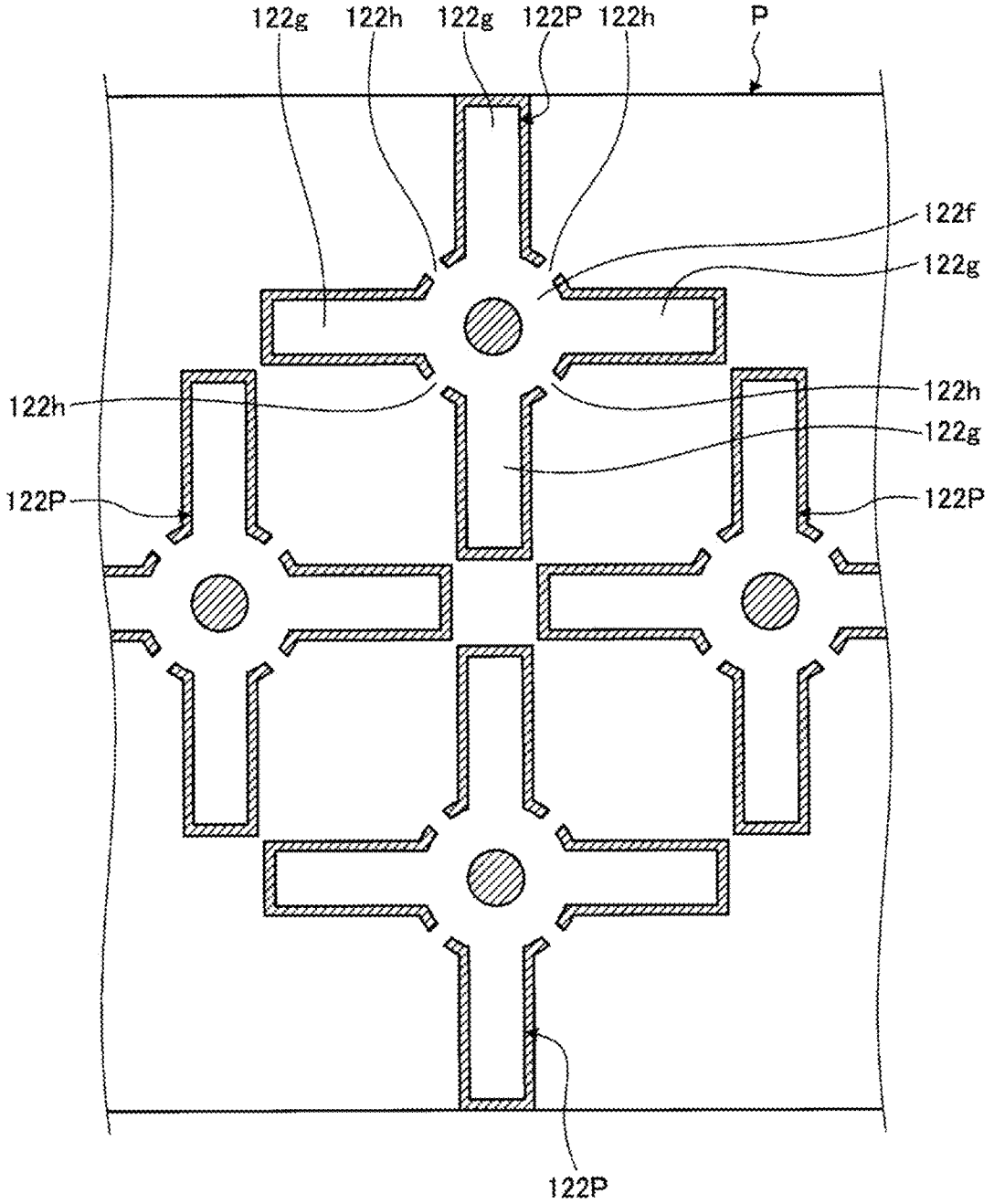
FIG. 6 is an exemplary and schematic diagram illustrating an arrangement in a metal plate of a punched shape of a spacer included in the piston pump of the embodiment.
Figure 7:
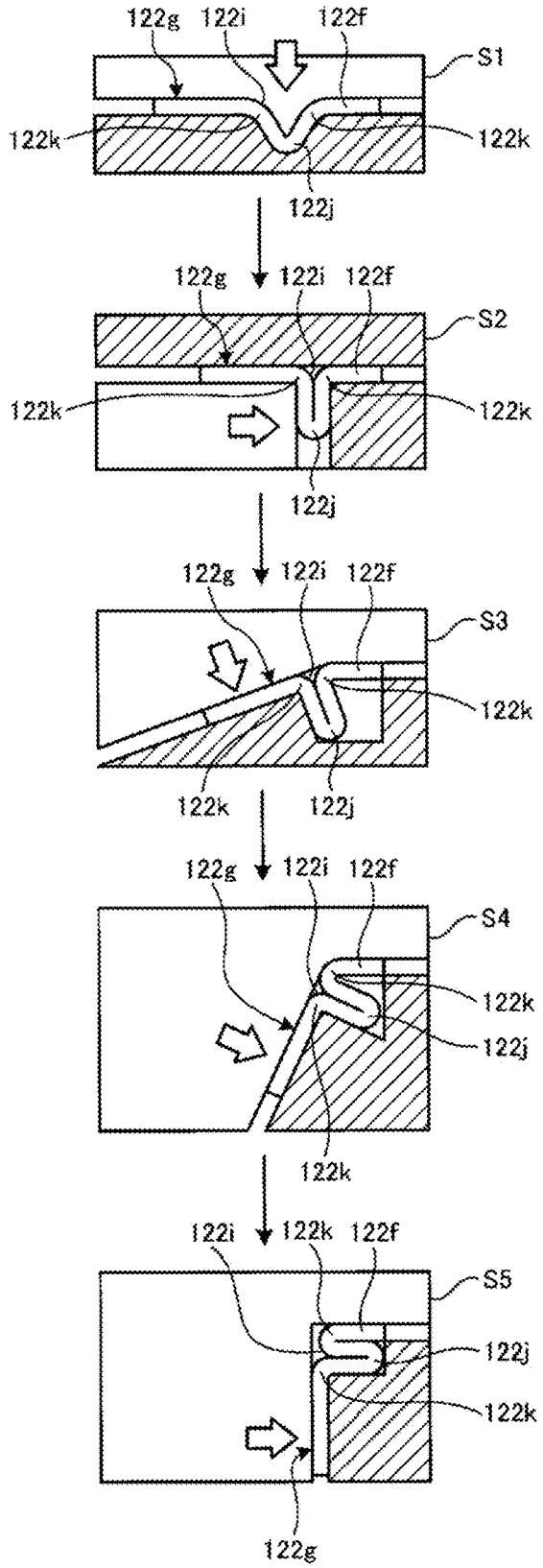
FIG. 7 is an exemplary and schematic diagram illustrating a molding step of a spacer included in the piston pump of the embodiment.

FIG. 6 is a diagram illustrating an arrangement of the initial punched shape 122P of the spacer 122 in a metal plate P. In FIG. 6, the part to be punched is hatched. Furthermore, FIG. 7 is a diagram illustrating a molding step of the spacer 122. The spacer 122 is molded by press working such as bending of the metal plate P.

As illustrated in FIG. 6, a plurality of punched shapes 122P are efficiently arranged on the metal plate P so that the dead area is as small as possible. The punched shape 122P includes a circular ring portion 122*f* and a plurality of (four) extending portions 122*g* extending radially outward from the circular ring portion 122*f* in a cross shape. The circular ring portion 122*f* becomes the base 122*a*, and the extending portion 122*g* becomes the bent portion 122*d* and the leg 122*b*.

The bending of the bent portion 122*d* and the leg 122*b* is executed in a state where the punched shape 122P is connected to the metal plate P. The punched shape 122P is connected to the metal plate P through a plurality of bridges 122*h*. The bridge 122*h* connects the circular ring portion 122*f* and the metal plate P.

As illustrated in S1 of FIG. 7, first, a V-shaped recess 122*i* is formed in the extending portion 122*g* by pressing (bending). The bottom portion 122*j* and the two top portions 122*k* of the recess 122*i* are the bending positions of the bent portion 122*d*.

Next, as illustrated in S2 of FIG. 7, by pressing (bending), the bending angle of the bottom portion 122*j* becomes 180°, the bending angle of the two top portions 122*k* becomes 90°, and the extending portion 122*g* is bent so that the two top portions 122*k* are in contact with each other to have a T shape.

Next, as illustrated in S3 to S5 of FIG. 7, by stepwise pressing (bending), the extending portion 122*g* is bent so that the bending angle of the top portion 122*k* close to the circular ring portion 122*f* becomes 180° while maintaining the bending angle of the top portion 122*k* of the two top portions 122*k* far from the circular ring portion 122*f* at 90°.

Finally, the molded spacer 122 is separated from the metal plate P by cutting the bridge 122*h*. The base 122*a* and the legs 122*b* of the spacer 122 have a plate-like shape, and may also be referred to as a plate-like part. The folding working illustrated in S2 to S5 for bringing the bent parts into close contact with each other may be referred to as a hemming working.

Furthermore, as illustrated in FIG. 2, the piston sub assembly 100 includes a first intake check valve 20. The first intake check valve 20 allows the inflow of the hydraulic fluid from the passage 100*a* into the first chamber R1 and prevents the outflow (backflow) of the hydraulic fluid from the first chamber R1 to the passage 100*a*. The first intake check valve 20 includes a coil spring 22 and a holder 23 in addition to the outer surface 121*g* and the first valve body 21 that function as the first valve seat described above. The first valve body 21 has a substantially spherical shape and is, for example, a steel ball or a synthetic resin ball.

The winding center of the coil spring 22 substantially coincides with the center line C. The coil spring 22 is sandwiched between the first valve body 21 and the holder 23 in an elastically compressed state, and urges the first valve body 21 axially rearward. The coil spring 22 elastically presses the first valve body 21 against the outer surface 121*g*. The coil spring 22 is an example of an urging member.

The holder 23 is provided adjacent to the cap 120. The holder 23 includes a base 23*a* and a cover 23*b*. The base 23*a* is provided in a posture intersecting the axial direction, and has a substantially disc-shape and annular shape. The protrusion 121*b* of the cover 121 is press-fitted into the opening 23*c* provided at the center of the base 23*a*, whereby the holder 23 is fixed to the cap 120. The base 23*a* may also be called a flange. The holder 23 is a member different from the cap 120 and can be made of, for example, a synthetic resin material. The holder 23 and the cap 120 may not be fixed by press fitting, and may be fixed by a coupling means other than press fitting, or may be configured to come into contact with each other in the axial direction to move integrally by the elastically repulsive force (urging force) of the return spring 101 and the pressure of the hydraulic fluid in the first chamber R1 without being fixed to each other.

The cover 23*b* has a side wall 23*d* and a top wall 23*e*. The side wall 23*d* extends axially forward from the inner edge of the base 23*a*. The side wall 23*d* is provided with a plurality of slit-shaped openings 23*f* extending in the axial direction. In other words, on the inner edge of the base 23*a* (peripheral edge of the opening 23*f*), a plurality of plate-like side walls 23*d* extending axially forward are provided at intervals (openings 23*f*) in the circumferential direction. The opening 23*f* can also be referred to as a rear surface opening or a side opening. A substantially cup-shaped top wall 23*e* having a bottomed recess that is open toward the axially front side is provided at the end on the axially front side of the side wall 23*d*. The top wall 23*e* is provided with a protrusion 23*g* projecting out axially rearward, and the protrusion 23*g* is inserted into the coil of the coil spring 22. The end on the axially front side of the coil spring 22 is held by the side wall 23*d*, the top wall 23*e*, and the protrusion 23*g*. The cover 23*b* is an example of a holding portion that holds the coil spring 22.

The outer edge of the base 23*a* is provided with an annular seal lip 23*h* extending axially forward and slightly extending radially outward. As illustrated in FIG. 1, the outer circumference of the seal lip 23*h* is in contact with the inner circumferential surface 30*a* of the first cylinder 30. The seal lip 23*h* functions as a seal portion that prevents leakage of hydraulic fluid from the first chamber R1 to the intake port 11*d* through the annular gap g1 (clearance) between the first cylinder 30 and the piston sub assembly 100. The holder 23 is an example of a seal member.

The first cylinder 30 is accommodated in the accommodation hole 11*a* of the body 11 (housing 10) so as to be closer to the axially front side, and forms the first chamber R1 with the piston sub assembly 100. The first cylinder 30 accommodates the piston sub assembly 100 so as to be axially reciprocable. The first cylinder 30 has a peripheral wall 31 and a top wall 32, and has a substantially bottomed cylindrical shape opened toward the axially rear side. The peripheral wall 31 has a substantially cylindrical shape. The top wall 32 has a substantially disc-shape that intersects the axial direction, and is connected to the end on the axially front side of the peripheral wall 31.

The return spring 101 is a coil spring having a center line C as a winding center, and is sandwiched between the holder 23 and the top wall 32 in an elastically compressed state, so that the holder 23, that is, the piston sub assembly 100, is urged axially rearward. The return spring 101 is an example of an urging member.

A filter plate 102 is sandwiched between the return spring 101 and the top wall 32 in a posture intersecting the axial direction. The filter plate 102 is provided with a plurality of through holes penetrating in the axial direction and through which the hydraulic fluid passes. The size of the through hole is set according to the size of the dust to be trapped.

A discharge check valve 40 is provided on the top wall 32. The discharge check valve 40 allows the outflow of the hydraulic fluid from the first chamber R1 to the discharge port 11*f*, and prevents the inflow (backflow) of the hydraulic fluid from the discharge port 11*f* to the first chamber R1. The discharge check valve 40 includes a third valve body 41, a coil spring 42, and a holder 43. The third valve body 41 has a substantially spherical shape, and is, for example, a steel ball or a synthetic resin ball. An opening 32*a* is provided at the center of the top wall 32, and an open edge 32*b* on the axially front side of the opening 32*a* functions as a third valve seat.

The winding center of the coil spring 42 substantially coincides with the center line C. The coil spring 42 is sandwiched between the third valve body 41 and the holder 43 in an elastically compressed state, and urges the third valve body 41 axially rearward. The coil spring 42 elastically presses the third valve body 41 against the open edge 32*b*. The coil spring 42 is an example of an urging member.

The holder 43 has a bottomed recess opened toward the axially rear side, and is press-fitted onto the outer circumference of a columnar protrusion 32*c* provided on the top wall 32, whereby the holder 43 is fixed to the first cylinder 30. The holder 43 can be made of, for example, a synthetic resin material.

The second cylinder 60 is accommodated in the accommodation hole 11*a* of the body 11 (housing 10) so as to be closer to the axially rear side, and forms the second chamber R2 with the piston sub assembly 100. The second cylinder 60 accommodates the piston sub assembly 100 so as to reciprocate in the axial direction. The second chamber R2 is located on the side opposite to the first chamber R1 with respect to the passage 100*a* and is connected to the inlet 100*a*1 of the passage 100*a*, and is connected to the first chamber R1 through the passage 100*a* when the first intake check valve 20 is in a valve-open state. When the piston sub assembly 100 moves axially forward (upward in FIG. 1), the first chamber R1 is contracted and the second chamber R2 is expanded. Conversely, when the piston sub assembly 100 moves axially rearward (downward in FIG. 1), the first chamber R1 is expanded and the second chamber R2 is contracted.

The second cylinder 60 has a peripheral wall 61 and a bottom wall 62, and has a substantially bottomed cylindrical shape opened axially rearward. The peripheral wall 61 has a substantially cylindrical shape. The bottom wall 62 has a substantially conical shape, and is spread axially forward around the center line C. An opening 62*a* is provided at the center of the bottom wall 62, and the plunger 110 is passed through the opening 62*a*.

An annular seal member 13 and a backup ring 14 surrounding the plunger 110 are fitted between the bottom wall 62 of the second cylinder 60 and the bottom wall 11*b* in the accommodation hole 11*a*, and the seal member 13 functions as a seal portion that prevents the leakage of hydraulic fluid from the second chamber R2 to the cam chamber R3 through the annular gap g3 (clearance) between the accommodation hole 11*a* and the plunger 110.

Furthermore, as illustrated in FIGS. 1 and 2, the spacer 122 (the leg 122*b* thereof) provided with the seal member 51, the inner circumferential surface 60*a* of the second cylinder 60, the flange 121*c* of the cover 121, and the notch 122*c* (see FIG. 3) can function as the second intake check valve 50. The second intake check valve 50 allows the inflow of the hydraulic fluid from the intake port 11*d* to the second chamber R2 and prevents the outflow (backflow) of the hydraulic fluid from the second chamber R2 to the intake port 11*d*. In the structure, the seal member 51 functions as a second valve body, and the flange 121*c* (axially rearward end surface thereof) functions as a second valve seat. The seal member 51 is in contact with the inner circumferential surface 60*a* of the second cylinder 60. Therefore, the seal member 51 inhibits the passing of the hydraulic fluid in the annular gap g2 between the inner circumferential surface 60*a* and the flange 121*c* while being in contact with the flange 121*c*. In this state, the outflow (backflow) of the hydraulic fluid from the second chamber R2 and the passage 100*a* to the intake port 11*d* is inhibited. Furthermore, in the seal member 51, in the state of being in contact with the claw 122*e*, the gap g2 between the inner circumferential surface 60*a* and the flange 121*c* is opened, and the notch 122*c* is exposed between the flange 121*c* and the claw 122*e*, so that the intake port 11*d* and the passage 100*a* are connected to each other through the gap g2 between the inner circumferential surface 60*a* and the flange 121*c* and the notch 122*c*. In this state, the inflow of the hydraulic fluid from the intake port 11*d* into the second chamber R2 and the passage 100*a* is allowed. The claw 122*e* functions as a stopper that restricts the movement of the seal member 51 in the valve opening direction. The notch 122*c* is an example of the third opening, and the gap g2 is an example of the second opening. Although the notch 122*c* functions as both the first opening and the third opening, this is not the sole case, and the first opening and the third opening may be provided in the spacer 122 or the cover 121 as independent holes or notches, recesses or the like.

Figure 8:
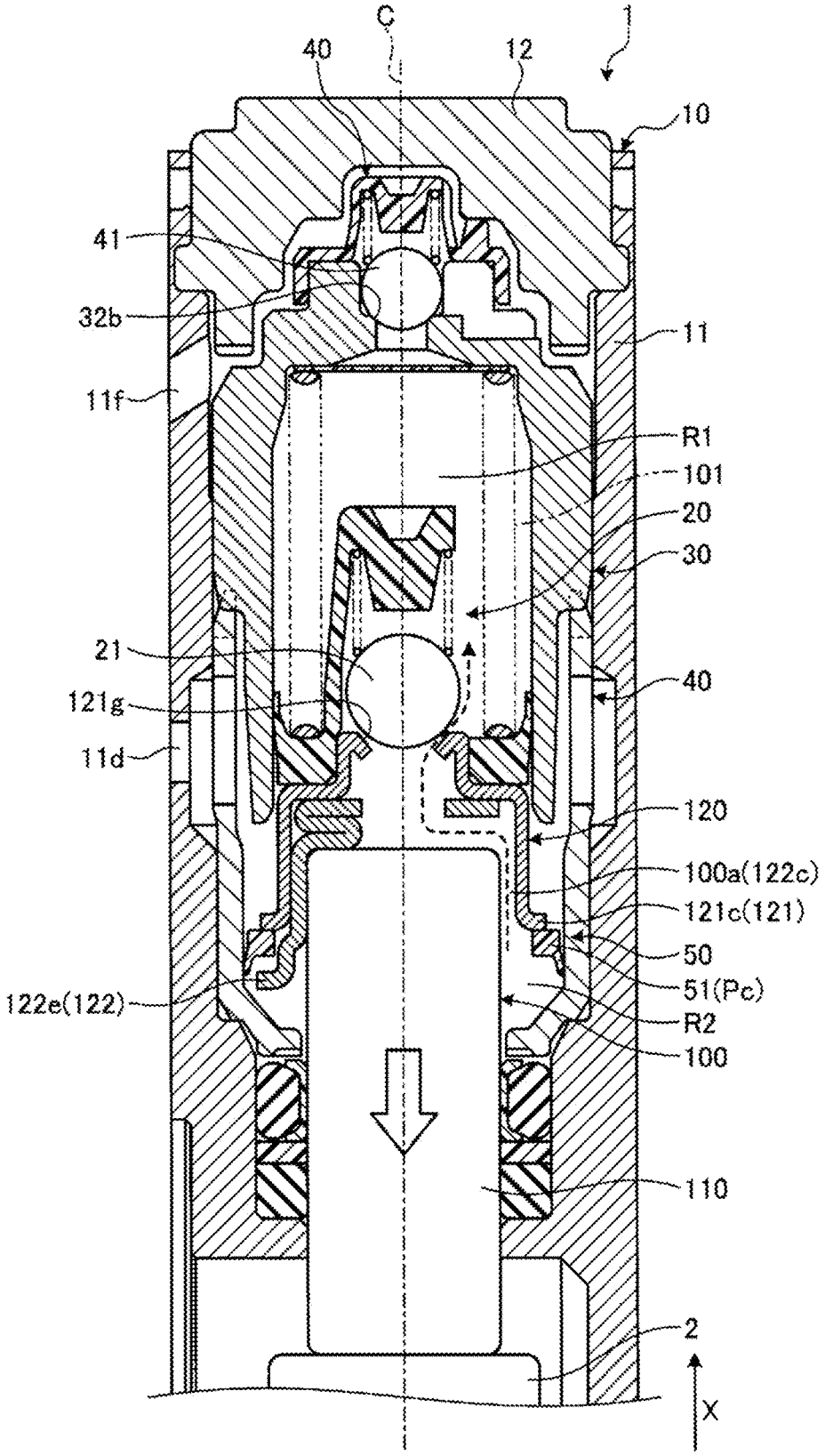
FIG. 8 is an exemplary and schematic cross-sectional view of the piston pump of the embodiment, and illustrates an intake step.

FIG. 8 is an operation diagram illustrating a state where the piston sub assembly 100 is moving axially rearward (downward in FIG. 8) in the intake step of the piston pump 1. Note that the left half of FIG. 8 is a cross-sectional view at the same cross-sectional position as in FIG. 1, and the right half of FIG. 8 is a cross-sectional view at the same cross-sectional position as in FIG. 5. In this case, the first chamber R1 is expanded and the second chamber R2 is contracted. As the second chamber R2 contracts, the seal member 51 moves toward the axially forward to a position Pc in contact with the flange 121*c* of the cover 121, whereby the second intake check valve 50 closes. The position Pc is an example of the valve closing position. Then, as the first chamber R1 expands and the second chamber R2 contracts, the hydraulic fluid in the second chamber R2 flows into the first chamber R1 through the passage 100*a* and the first intake check valve 20 that is in the valve-open state.

Figure 9:
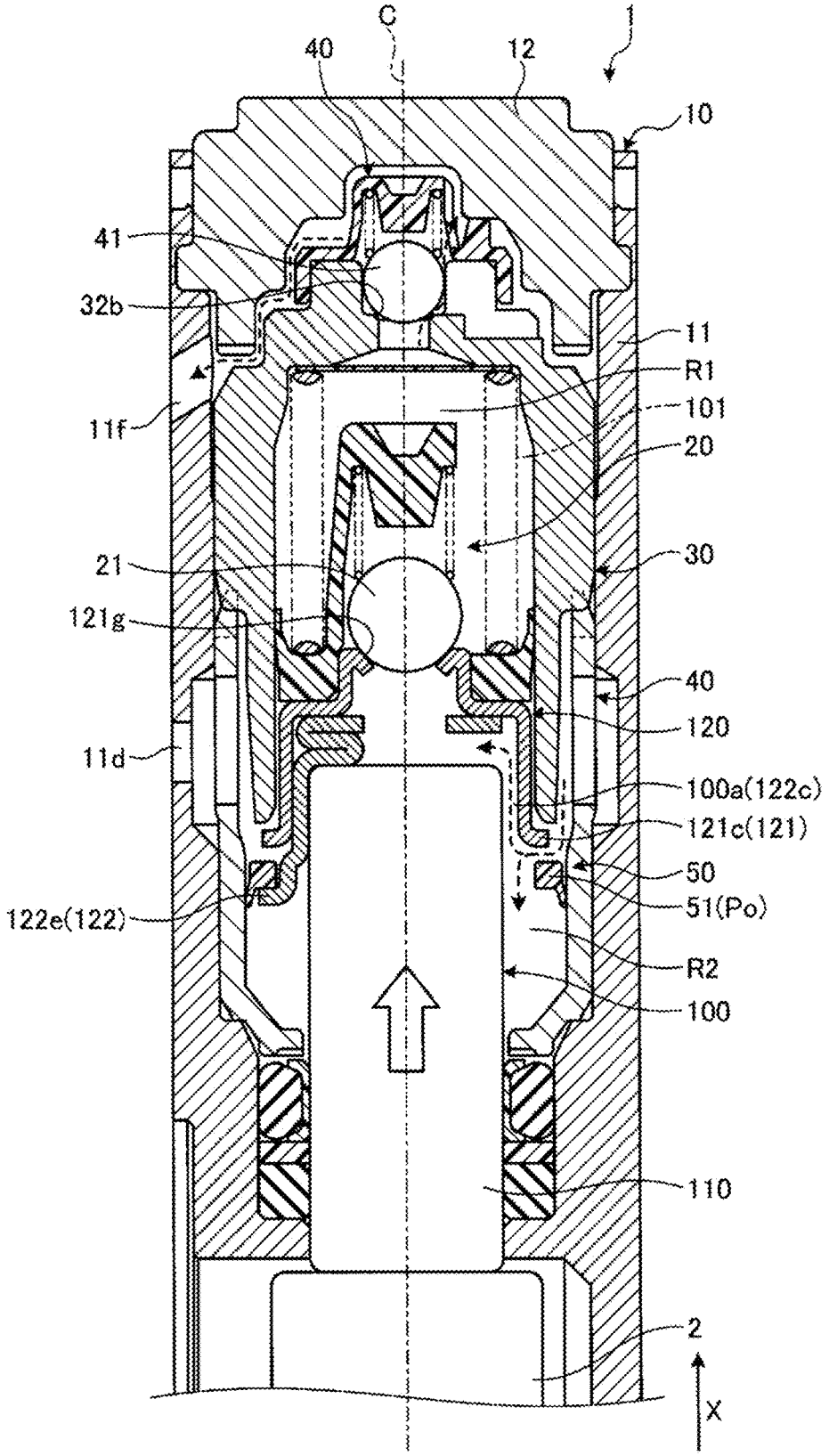
FIG. 9 is an exemplary and schematic cross-sectional view of the piston pump of the embodiment, and illustrates a discharge step.

FIG. 9 is an operation diagram illustrating a state where the piston sub assembly 100 is moving axially forward (upward in FIG. 9) in the discharge step of the piston pump 1. Note that the left half of FIG. 9 is a cross-sectional view at the same cross-sectional position as in FIG. 1, and the right half of FIG. 9 is a cross-sectional view at the same cross-sectional position as in FIG. 5. In this case, the first chamber R1 is contracted and the second chamber R2 is expanded. As the second chamber R2 expands, the seal member 51 moves axially rearward to a position Po in contact with the claw 122*e* of the spacer 122, whereby the second intake check valve 50 opens, and the hydraulic fluid flows into the second chamber R2 and the passage 100*a* from the intake port 11*d*. That is, in the discharge step, the passage 100*a* and the second chamber R2 are filled with the hydraulic fluid. The position Po is an example of the valve opening position. Furthermore, as the first chamber R1 contracts, the hydraulic fluid in the first chamber R1 flows out to the discharge port 11*f* through the discharge check valve 40 that is in the valve-open state.

As described above, in the present embodiment, the piston sub assembly 100 includes the holder 23 (seal member) with the seal lip 23*h* separate from the cap 120. With such a configuration, for example, since the cap 120 and the holder 23 can be made of different materials, the piston sub assembly 100 can be made of a more suitable material as compared with a case where the cap 120 and the holder 23 are integrally formed.

Furthermore, in the present embodiment, the cap 120 is made of a metal material, and the holder 23 having the seal lip 23*h* is made of a synthetic resin material. According to such a configuration, for example, it is easy to ensure the rigidity and strength of the piston sub assembly 100 by forming the cap 120 with a metal material, and it is easy to ensure sealing performance by the holder 23 including the seal lip 23*h* (seal portion) by forming the holder 23 with a synthetic resin material.

In addition, in the present embodiment, the cap 120 includes the cover 121 and the spacer 122. According to such a configuration, for example, the labor and cost in manufacturing the piston sub assembly 100 can be easily reduced as the passage 100*a* (intake passage) is more easily formed, and the plunger 110, the cover 121, and the spacer 122 can be integrated by press-fitting, as compared with ae case where the cap 120 is formed of one member. Furthermore, as at least one of the cover 121 and the spacer 122 is manufactured by press molding from a metal plate, the labor and cost are likely to be reduced as compared with a case where manufacturing is carried out through another method.

Furthermore, in the present embodiment, the spacer 122 includes the bent portion 122*d* located between the cap 120 and the end surface 110*c* (first end surface) of the plunger 110. According to such a configuration, for example, since the bent portion 122*d* capable of expanding the flow path cross-section of the passage 100*a* can be obtained relatively easily by press molding (bend molding) or the like, the labor and cost in manufacturing the piston sub assembly 100 is likely to be reduced.

Furthermore, in the present embodiment, the cap 120 (the cover 121 and the spacer 122) is provided with the seal member 51, the flange 121*c* (the second valve seat), and the notch 122*c* (the third opening), so that a mechanism for supplying the hydraulic fluid from the second chamber R2 in the intake step of the first chamber R1 can be incorporated in the piston sub assembly 100. Therefore, for example, even when the viscosity of the hydraulic fluid is high, such as when the temperature is low, the hydraulic fluid can be more reliably supplied to the first chamber R1, so that insufficient discharge amount of the hydraulic fluid of the piston pump 1 is easily avoided.

Moreover, in the present embodiment, the holder 23 (seal member) has a cover 23*b* (holding portion) that holds the coil spring 22 of the first intake check valve 20. According to such a configuration, the number of components is reduced, and the labor and cost in manufacturing are likely to be reduced as compared with a case where the holding portion is provided as a separate component from the holder 23.

The embodiment of the present disclosure has been exemplified above, but the embodiment described above is merely an example and is not intended to limit the scope of the present disclosure. The embodiment described above can be implemented in various other forms, and various omissions, replacements, combinations, and changes can be made within a scope not deviating from the gist of the disclosure. In addition, the specifications of each configuration, shape, and the like (structure, type, direction, shape, size, length, width, thickness, height, number, arrangement, position, material, etc.) can be appropriately changed and implemented.

For example, the cap may be one piece. Furthermore, the passage may be formed by a hole or a groove formed in the cap. Furthermore, instead of the bent portion provided on the spacer to increase the cross-section of the intake passage, a protrusion may be provided on the cover of the cap or the spacer. Moreover, the cap is not limited to a metal material.

In addition, the bent portion provided on the spacer merely needs to have a configuration capable of increasing the gap between the first end surface of the plunger and the base of the spacer or the top wall of the cover by partially increasing the axial height of the spacer, and is not limited to the configuration of the embodiment described above. Moreover, the bent shape and the bent direction of the bent portion are not limited to those in the embodiment described above. Furthermore, the bent portion may not be folded in a zigzag shape, and may be bent in a V shape, a U shape with a gap, a wavy shape, or the like. Furthermore, the bent portion may be provided separately from the leg of the spacer.

The invention claimed is:

1. A piston pump comprising: a first cylinder; and a piston sub assembly that reciprocates in an axial direction of the first cylinder in the first cylinder to expand and contract a first chamber provided between the first cylinder and the piston sub assembly; wherein the piston sub assembly includes, a columnar plunger that lies along the axial direction, a cap that is fixed with the plunger to cover an adjacent region of the plunger between a first end surface at one end in the axial direction of the plunger and a first outer circumferential surface of the plunger, and provided with an intake passage extending from an inlet on an outer side of the first outer circumferential surface to an outlet on an outer side of the first end surface of the plunger, and a first valve seat of a first intake check valve located at the outlet, and a seal member that is a member different from the cap and that prevents leakage of hydraulic fluid from the first chamber through a gap between the first cylinder and the piston sub assembly; and the cap includes, a cover that covers the first end surface and the adjacent region, and a spacer that is a member different from the cover and that is at least partially interposed between the cover and the first end surface and the adjacent region of the plunger, and that is provided with a first opening that forms the intake passage, the piston pump further comprising: a second cylinder that accommodates the piston sub assembly to reciprocate in the axial direction, and that forms a second chamber that is provided between the second cylinder and the piston sub assembly and that connects to the inlet of the intake passage on a side of the intake passage opposite to the first chamber, and the second chamber contracts as the first chamber expands and the second chamber expands as the first chamber contracts in relation to a movement of the piston sub assembly; and a second intake check valve that allows hydraulic fluid to flow from an intake port to the second chamber or the intake passage and inhibits hydraulic fluid from flowing from the second chamber or the intake passage to the intake port; wherein the second intake check valve includes, an annular second valve seat that is provided on the cover and that faces a side opposite to the first end surface of the plunger, and an annular second valve body provided to surround an outer circumference of the spacer to be movable between a valve closing position and a valve opening position in a state of being in slidable contact with an inner circumferential surface of the second cylinder in the axial direction, wherein the valve closing position is a position in which the annular second valve body comes into contact with the second valve seat and closes an annular second opening provided between the second valve seat and the inner circumferential surface of the second cylinder, and the annular second valve body moves away from the first end surface when changing from the valve closing position to the valve opening position; the first opening of the spacer connects the second opening to at least one of the second chamber or the intake passage in a state where the second valve body is at the valve opening position; as the second chamber expands, the second valve body is located at the valve opening position, and the hydraulic fluid flows into the second chamber and the intake passage from the intake port through the second opening and the first opening; and as the second chamber contracts, the second valve body is located at the valve closing position, and the hydraulic fluid is inhibited from flowing to the intake port from the second chamber and the intake passage through the first opening and the second opening, and the hydraulic fluid flows into the first chamber from the second chamber through the intake passage and the first intake check valve.

2. The piston pump according to claim 1, wherein
the cap is made of a metal material, and
the seal member is made of a synthetic resin material.

3. The piston pump according to claim 1, wherein the spacer has a bent portion having a bent plate shape, and that is located between the cover and the first end surface.

4. The piston pump according to claim 1, wherein the seal member includes a holding portion that holds an urging member that urges a first valve body of the first intake check valve from a side of the first intake check valve opposite to the first valve seat.

5. The piston pump according to claim 2, wherein the spacer has a bent portion having a bent plate shape, and that is located between the cover and the first end surface.

6. A piston pump comprising:
a first cylinder; and
a piston sub assembly that reciprocates in an axial direction of the first cylinder in the first cylinder to expand and contract a first chamber provided between the first cylinder and the piston sub assembly; wherein
the piston sub assembly includes,
a columnar plunger that lies along the axial direction,
a cap that is fixed with the plunger to cover an adjacent region of the plunger between a first end surface at one end in the axial direction of the plunger and a first outer circumferential surface of the plunger, and provided with an intake passage extending from an inlet on an outer side of the first outer circumferential surface to an outlet on an outer side of the first end surface of the plunger, and a first valve seat of a first intake check valve located at the outlet, and
a seal member that is a member different from the cap and that prevents leakage of hydraulic fluid from the first chamber through a gap between the first cylinder and the piston sub assembly; and
the cap includes,
a cover that covers the first end surface and the adjacent region, and
a spacer that is a member different from the cover and that is at least partially interposed between the cover and the first end surface and the adjacent region of the plunger, and that is provided with a first opening that forms the intake passage, the cap is made of a metal material, the seal member is made of a synthetic resin material, and the seal member includes a holding portion that holds an urging member that urges a first valve body of the first intake check valve from a side of the first intake check valve opposite to the first valve seat.

7. The piston pump according to claim 6, further comprising: a second cylinder that accommodates the piston sub assembly to reciprocate in the axial direction, and that forms a second chamber that is provided between the second cylinder and the piston sub assembly and that connects to the inlet of the intake passage on a side of the intake passage opposite to the first chamber, and the second chamber contracts as the first chamber expands and the second chamber expands as the first chamber contracts in relation to a movement of the piston sub assembly; and a second intake check valve that allows hydraulic fluid to flow from an intake port to the second chamber or the intake passage and inhibits hydraulic fluid from flowing from the second chamber or the intake passage to the intake port; wherein the second intake check valve includes, an annular second valve seat that is provided on the cover and that faces a side opposite to the first end surface of the plunger, and an annular second valve body provided to surround an outer circumference of the spacer to be movable between a valve closing position and a valve opening position in a state of being in slidable contact with an inner circumferential surface of the second cylinder in the axial direction, wherein the valve closing position is a position in which the annular second valve body comes into contact with the second valve seat and closes an annular second opening provided between the second valve seat and the inner circumferential surface of the second cylinder, and the annular second valve body moves away from the first end surface when changing from the valve closing position to the valve opening position; the first opening of the spacer connects the second opening to at least one of the second chamber or the intake passage in a state where the second valve body is at the valve opening position; as the second chamber expands, the second valve body is located at the valve opening position, and the hydraulic fluid flows into the second chamber and the intake passage from the intake port through the second opening and the first opening; and as the second chamber contracts, the second valve body is located at the valve closing position, and the hydraulic fluid is inhibited from flowing to the intake port from the second chamber and the intake passage through the first opening and the second opening, and the hydraulic fluid flows into the first chamber from the second chamber through the intake passage and the first intake check valve.

8. A piston pump comprising:

a first cylinder; and a piston sub assembly that reciprocates in an axial direction of the first cylinder in the first cylinder to expand and contract a first chamber provided between the first cylinder and the piston sub assembly; wherein the piston sub assembly includes, a columnar plunger that lies along the axial direction, a cap that is fixed with the plunger to cover an adjacent region of the plunger between a first end surface at one end in the axial direction of the plunger and a first outer circumferential surface of the plunger, and provided with an intake passage extending from an inlet on an outer side of the first outer circumferential surface to an outlet on an outer side of the first end surface of the plunger, and a first valve seat of a first intake check valve located at the outlet, and a seal member that is a member different from the cap and that prevents leakage of hydraulic fluid from the first chamber through a gap between the first cylinder and the piston sub assembly; and the cap includes, a cover that covers the first end surface and the adjacent region, and a spacer that is a member different from the cover and that is at least partially interposed between the cover and the first end surface and the adjacent region of the plunger, and that is provided with a first opening that forms the intake passage, the spacer has a bent portion having a bent plate shape, and that is located between the cover and the first end surface, and the seal member includes a holding portion that holds an urging member that urges a first valve body of the first intake check valve from a side of the first intake check valve opposite to the first valve seat.

9. The piston pump according to claim 8, further comprising: a second cylinder that accommodates the piston sub assembly to reciprocate in the axial direction, and that forms a second chamber that is provided between the second cylinder and the piston sub assembly and that connects to the inlet of the intake passage on a side of the intake passage opposite to the first chamber, and the second chamber contracts as the first chamber expands and the second chamber expands as the first chamber contracts in relation to a movement of the piston sub assembly; and a second intake check valve that allows hydraulic fluid to flow from an intake port to the second chamber or the intake passage and inhibits hydraulic fluid from flowing from the second chamber or the intake passage to the intake port; wherein the second intake check valve includes, an annular second valve seat that is provided on the cover and that faces a side opposite to the first end surface of the plunger, and an annular second valve body provided to surround an outer circumference of the spacer to be movable between a valve closing position and a valve opening position in a state of being in slidable contact with an inner circumferential surface of the second cylinder in the axial direction, wherein the valve closing position is a position in which the annular second valve body comes into contact with the second valve seat and closes an annular second opening provided between the second valve seat and the inner circumferential surface of the second cylinder, and the annular second valve body moves away from the first end surface when changing from the valve closing position to the valve opening position; the first opening of the spacer connects the second opening to at least one of the second chamber or the intake passage in a state where the second valve body is at the valve opening position; as the second chamber expands, the second valve body is located at the valve opening position, and the hydraulic fluid flows into the second chamber and the intake passage from the intake port through the second opening and the first opening; and as the second chamber contracts, the second valve body is located at the valve closing position, and the hydraulic fluid is inhibited from flowing to the intake port from the second chamber and the intake passage through the first opening and the second opening, and the hydraulic fluid flows into the first chamber from the second chamber through the intake passage and the first intake check valve.

* * * * *